US006874547B1

(12) United States Patent
Dorr et al.

(10) Patent No.: US 6,874,547 B1
(45) Date of Patent: Apr. 5, 2005

(54) NITROUS OXIDE TRANSFER SYSTEM

(76) Inventors: Darlene Dorr, 8740 Orient Way NE., St. Petersburg, FL (US) 33702; William F. Dorr, 8740 Orient Way NE., St. Petersburg, FL (US) 33702

( * ) Notice: Subject to any disclaimer, the term of this patent is extended or adjusted under 35 U.S.C. 154(b) by 0 days.

(21) Appl. No.: 10/714,718

(22) Filed: Nov. 17, 2003

(51) Int. Cl.[7] ..... B65B 1/30
(52) U.S. Cl. ..... 141/83; 141/82; 62/50.1
(58) Field of Search ..... 141/18, 47, 49, 141/51, 82, 83; 62/50.1, 304, 306

(56) References Cited

U.S. PATENT DOCUMENTS 2,075,408 A * 3/1937 Sholes ..... 62/50.1
4,531,558 A * 7/1985 Engel et al. ..... 141/44
4,657,055 A * 4/1987 Poulsen ..... 141/83

* cited by examiner

*Primary Examiner*—Timothy L. Maust
(74) *Attorney, Agent, or Firm*—Edward P. Dutkiewicz

(57) ABSTRACT

A housing has a vertical separation wall. The vertical separation wall forms a filling chamber on one side. The housing has a horizontal separation wall on the other side. The horizontal separation wall forms a cooling chamber. A quantity of a liquid in the filling chamber has an apertured horizontal plate at about the middle elevation of the filling chamber. A smaller end-user tank is provided on the plate. The level of liquid is sufficient to immerse the lower portion of a smaller end-user tank. An air conditioning system includes a compressor unit located in the cooling chamber. The air conditioning system includes a refrigerant coil in the filling chamber beneath the plate. A large supply tank of gas is laterally displaced from the housing. A supply tube connects the large supply tank with the smaller end-user tank within the housing.

5 Claims, 2 Drawing Sheets

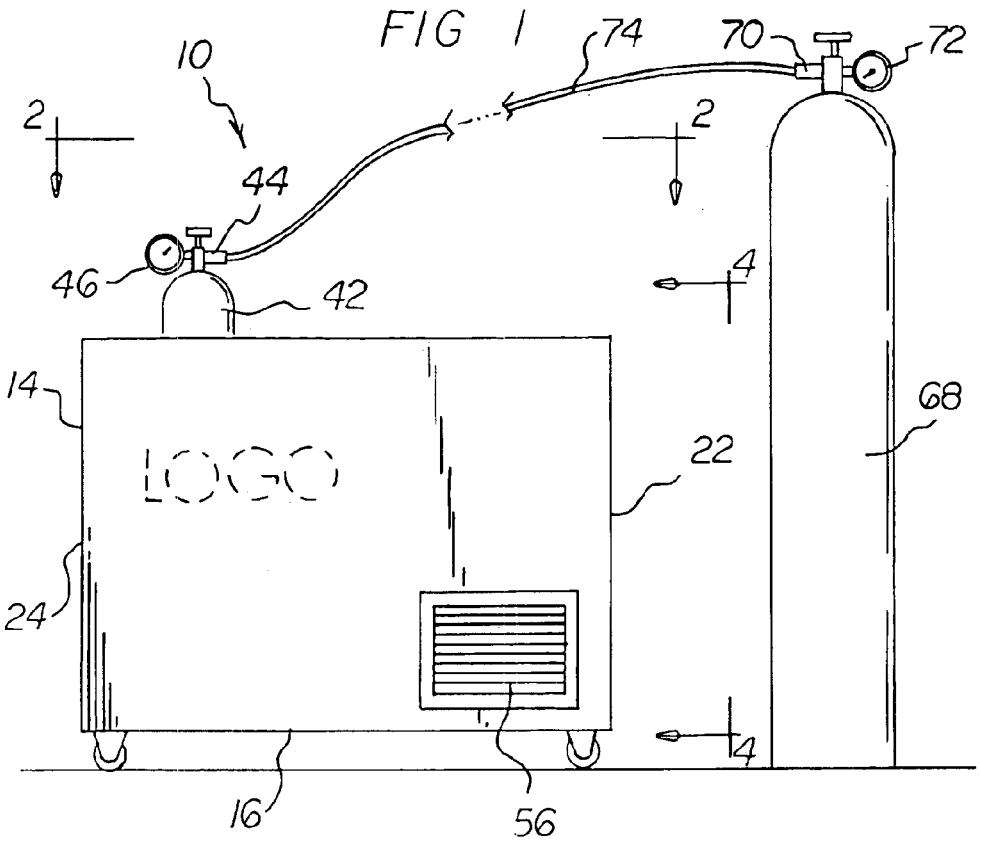
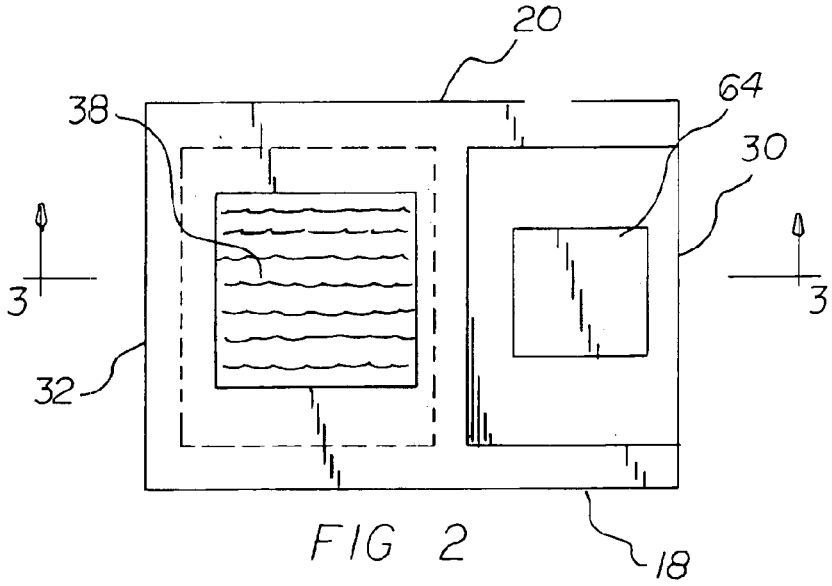
FIG 2

FIG 3
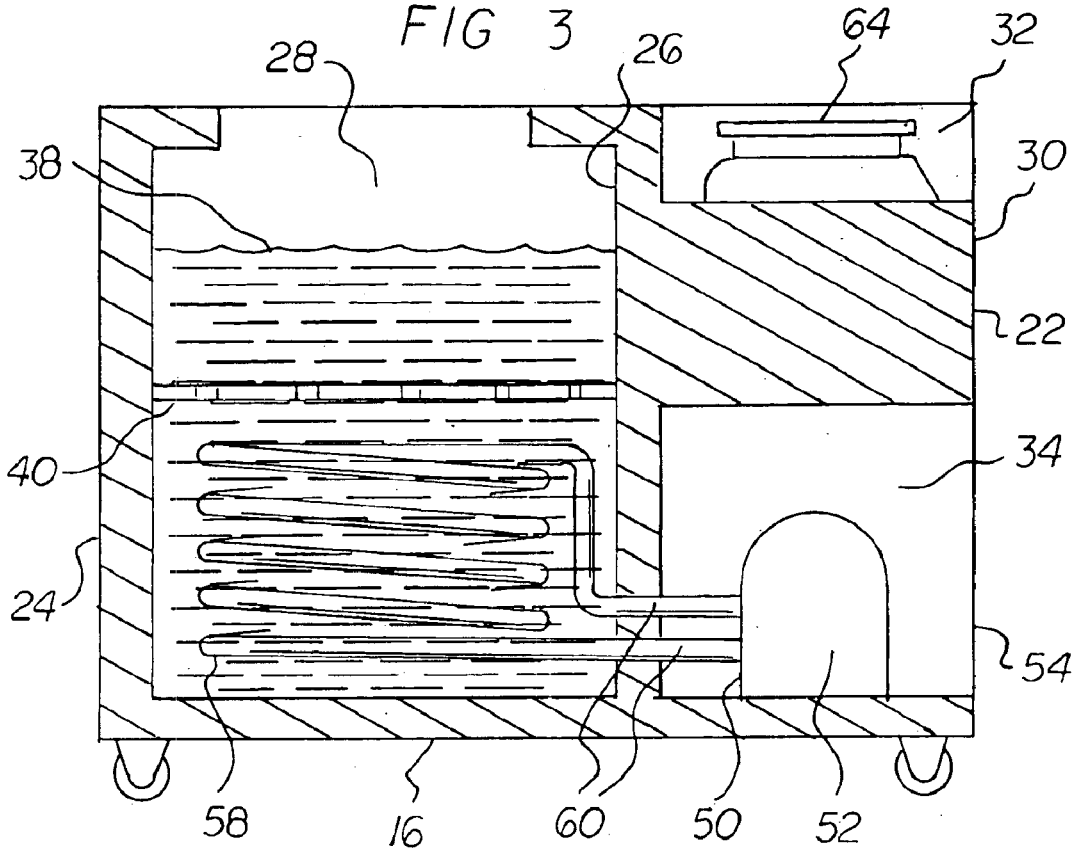
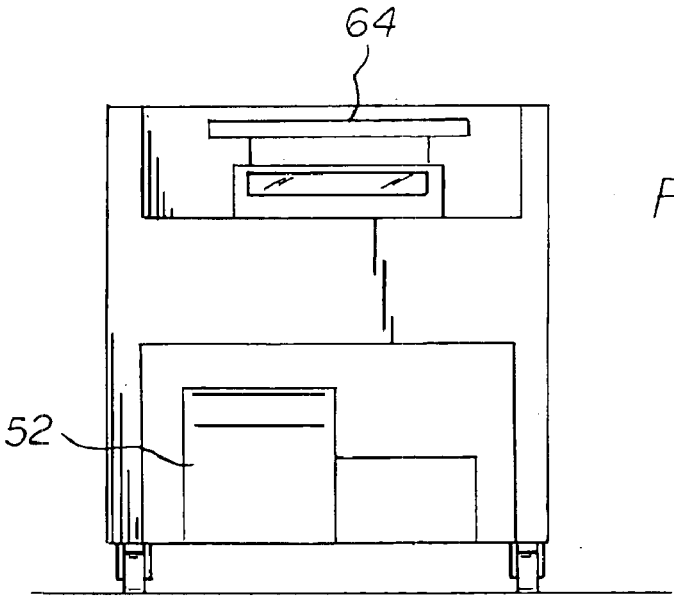
FIG 4

NITROUS OXIDE TRANSFER SYSTEM

BACKGROUND OF THE INVENTION

1. Field of the Invention

The present invention relates to a nitrous oxide transfer system and more particularly pertains to facilitating the transfer of gas from a large supply tank to smaller end-user tanks.

2. Description of the Prior Art

The use of gas transfer methods and systems of known designs and configurations is known in the prior art. More specifically, gas transfer methods and systems of known designs and configurations previously devised and utilized for the purpose of transferring gas through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,473,904 issued Dec. 12, 1995 to Guo relates to a method and apparatus for generating, transporting and dissociating gas hydrates. U.S. Pat. No. 5,865,877 issued Feb. 2, 1999 to Delp relates to a method and apparatus for supplying a pressurized diver's breathing gas for underwater diving. U.S. Pat. No. 5,941,081 issued Aug. 24, 1999 to Burgner relates to a solid phase latent heat vapor extraction and recovery system for liquified gases. Lastly, U.S. Pat. No. 6,347,627 issued Feb. 19, 2002 to Frankie relates to a nitrous oxide based oxygen system.

While these devices fulfill their respective, particular objectives and requirements, the aforementioned patents do not describe nitrous oxide transfer system that allows facilitating the transfer of gas from a large supply tank to smaller end-user tanks.

In this respect, the nitrous oxide transfer system according to the present invention substantially departs from the conventional concepts and designs of the prior art, and in doing so provides an apparatus primarily developed for the purpose of facilitating the transfer of gas from a large supply tank to smaller end-user tanks.

Therefore, it can be appreciated that there exists a continuing need for a new and improved nitrous oxide transfer system which can be used for facilitating the transfer of gas from a large supply tank to smaller end-user tanks. In this regard, the present invention substantially fulfills this need.

SUMMARY OF THE INVENTION

In view of the foregoing disadvantages inherent in the known types of gas transfer methods and systems of known designs and configurations now present in the prior art, the present invention provides an improved nitrous oxide transfer system. As such, the general purpose of the present invention, which will be described subsequently in greater detail, is to provide a new and improved nitrous oxide transfer system and method which has all the advantages of the prior art and none of the disadvantages.

To attain this, the present invention essentially comprises a housing. The housing is in a generally rectilinear configuration. The housing has a horizontal bottom wall and four vertical side walls. The vertical side walls include a front wall, a rear wall, an open side wall and a closed side wall. The housing also has a vertical separation wall. The vertical separation wall forms a filling chamber on one side of the vertical separation wall. The housing further has a horizontal separation wall on the other side of the vertical separation wall. The horizontal separation wall forms a weighing chamber above and a cooling chamber below.

A quantity of brine is provided. The brine is in the filling chamber. The filling chamber has an apertured horizontal plate at about the middle elevation of the filling chamber. A smaller end-user tank is provided. The end-user tank is supported on the plate for being filled. The level of brine is sufficient to immerse the lower portion of the smaller end-user tank. The smaller end-user tank has an upper end. The upper end has a fitting and a gage. The smaller end-user tank is of a size sufficient to maintain the upper end above the brine and the housing.

Provided next is an air conditioning system. The air conditioning system has a compressor unit. The compressor unit is located in the cooling chamber. An opening is provided in the open side wall adjacent to the compressor unit for repair purposes as may be needed. A louver is provided in the front wall adjacent to the compressor unit for ventilation. The air conditioning system also includes a refrigerant coil. The refrigerant coil is provided in the filling chamber beneath the plate. Connecting lines extend through the vertical separation wall. In this manner the air conditioning system will cool the smaller end-user tank there during the filling of the end-user tank.

Further provided is a scale. The scale is located in the weighing chamber. The scale is supported upon the horizontal separation wall. The scale is adapted to weigh the smaller end-user tanks prior to being filled and again after being filled.

Provided last is a large supply tank of nitrous oxide. The supply tank is laterally displaced from the housing. The supply tank has an upper end. The upper end has fittings, a gage, and a supply tube. The supply tube connects the large supply tank with the smaller end-user tank within the housing. In this manner nitrous oxide may be transferred from the large supply tank to the smaller end-user tank during operation of the air conditioning system. In this manner the transfer of nitrous oxide gas from the large supply tank to the smaller end-user tanks may be accelerated by the cooling of the smaller end-user tanks.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved nitrous oxide transfer system which has all of the advantages of the prior art gas transfer methods and systems of known designs and configurations and none of the disadvantages.

It is another object of the present invention to provide a new and improved nitrous oxide transfer system which may be easily and efficiently manufactured and marketed.

It is further object of the present invention to provide a new and improved nitrous oxide transfer system which is of durable and reliable constructions.

An even further object of the present invention is to provide a new and improved nitrous oxide transfer system which is susceptible of a low cost of manufacture with regard to both materials and labor, and which accordingly is then susceptible of low prices of sale to the consuming public, thereby making such nitrous oxide transfer system economically available to the buying public.

Even still another object of the present invention is to provide a nitrous oxide transfer system for facilitating the transfer of gas from a large supply tank to smaller end-user tanks.

Lastly, it is an object of the present invention to provide a new and improved nitrous oxide transfer system. A housing has a vertical separation wall. The vertical separation wall forms a filling chamber on one side. The housing has a horizontal separation wall on the other side. The horizontal separation wall forms a cooling chamber. A quantity of a liquid in the filling chamber has an apertured horizontal plate at about the middle elevation of the filling chamber. A smaller end-user tank is provided on the plate. The level of liquid is sufficient to immerse the lower portion of a smaller end-user tank. An air conditioning system includes a compressor unit located in the cooling chamber. The air conditioning system includes a refrigerant coil in the filling chamber beneath the plate. A large supply tank of gas is laterally displaced from the housing. A supply tube connects the large supply tank with the smaller end-user tank within the housing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of a nitrous oxide transfer system constructed in accordance with the principles of the present invention.

FIG. 2 is a plan view of the housing of the nitrous oxide transfer system taken along line 2—2 of FIG. 1.

FIG. 3 is a cross sectional view of the housing taken along line 3—3 of FIG. 2.

FIG. 4 is a side elevational view the housing taken along line 4—4 of FIG. 1.

The same reference numerals refer to the same parts throughout the various figures.

DESCRIPTION OF THE PREFERRED EMBODIMENT

With reference now to the drawings, and in particular to FIG. 1 thereof, the preferred embodiment of the new and improved nitrous oxide transfer system embodying the principles and concepts of the present invention and generally designated by the reference numeral 10 will be described.

The present invention, the nitrous oxide transfer system 10 is comprised of a plurality of components. Such components in their broadest context include a housing, a quantity of liquid, an air conditioning system, and a large supply tank of gas. Such components are individually configured and correlated with respect to each other so as to attain the desired objective.

First provided is a housing 14. The housing is in a generally rectilinear configuration. The housing has a horizontal bottom wall 16 and four vertical side walls. The vertical side walls include a front wall 18, a rear wall 20, an open side wall 22 and a closed side wall 24. The housing also has a vertical separation wall 26. The vertical separation wall forms a filling chamber 28 on one side of the vertical separation wall. The housing further has a horizontal separation wall 30 on the other side of the vertical separation wall. The horizontal separation wall forms a weighing chamber 32 above and a cooling chamber 34 below.

A quantity of brine 38 is provided. The brine is in the filling chamber. The filling chamber has an apertured horizontal plate 40 at about the middle elevation of the filling chamber. A smaller end-user tank 42 is provided. The end-user tank is supported on the plate for being filled. The level of brine is sufficient to immerse the lower portion of the smaller end-user tank. The smaller end-user tank has an upper end. The upper end has a fitting 44 and a gage 46. The smaller end-user tank is of a size sufficient to maintain the upper end above the brine and the housing.

Provided next is an air conditioning system 50. The air conditioning system has a compressor unit 52. The compressor unit is located in the cooling chamber. An opening is provided in the open side wall 54 adjacent to the compressor unit for repair purposes as may be needed. A louver 56 is provided in the front wall adjacent to the compressor unit for ventilation. The air conditioning system also includes a refrigerant coil 58. The refrigerant coil is provided in the filling chamber beneath the plate. Connecting lines 60 extend through the vertical separation wall. In this manner the air conditioning system will cool the smaller end-user tank there during the filling of the end-user tank.

Further provided is a scale 64. The scale is located in the weighing chamber. The scale is supported upon the horizontal separation wall. The scale is adapted to weigh the smaller end-user tanks prior to being filled and again after being filled.

Provided last is a large supply tank 68 of nitrous oxide. The supply tank is laterally displaced from the housing. The supply tank has an upper end. The upper end has fittings 70, a gage 72, and a supply tube 74. The supply tube connects the large supply tank with the smaller end-user tank within the housing. In this manner nitrous oxide may be transferred from the large supply tank to the smaller end-user tank during operation of the air conditioning system. In this manner the transfer of nitrous oxide gas from the large supply tank to the smaller end-user tanks may be accelerated by the cooling of the smaller end-user tanks.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A nitrous oxide transfer system for facilitating the transfer of gas from a large supply tank to smaller end-user tanks in a safe and efficient manner comprising, in combination:

a housing in a generally rectilinear configuration with a horizontal bottom wall and four vertical side walls including a front wall, a rear wall, an open side wall and a closed side wall, the housing also having a vertical separation wall forming a filling chamber on one side of the vertical separation wall and having a horizontal separation wall on the other side of the vertical separation wall, the horizontal separation wall forming a weighing chamber above and a cooling chamber below;

a quantity of brine in the filling chamber with an apertured horizontal plate at about the middle elevation of the filling chamber and with a smaller end-user tank supported on the plate for being filled, the level of brine being sufficient to immerse the lower portion of the smaller end-user tank providing direct fluid-to-tank-wall contact, the smaller end-user tank having an upper end with a fitting and a gage with the size of the smaller end-user tank being sufficient to maintain the upper end above the brine and the housing;

an air conditioning system for cooling the brine, the air conditioning system including a compressor unit located in the cooling chamber with an opening in the open side wall adjacent to the compressor unit for repair purposes as may be needed and a louver in the front wall adjacent to the compressor unit for ventilation, the air conditioning system also including a refrigerant coil in the filling chamber beneath the plate and with connecting lines extending through the vertical separation wall whereby the air conditioning system will cool the smaller end-user tank there above during the filling thereof;

a scale located in the weighing chamber and supported upon the horizontal separation wall, the scale adapted to weigh the smaller end-user tanks prior to being filled and again after being filled; and a large supply tank of nitrous oxide remotely located from the housing and having an upper end with fittings and a gage and a supply tube connecting the large supply tank with the smaller end-user tank within the housing for the transfer of nitrous oxide from the large supply tank to the smaller end-user tank during operation of the air conditioning system whereby transfer of nitrous oxide gas from the large supply tank to the smaller end-user tanks is accelerated by the cooling of the smaller end-user tanks.

2. A gas transfer system comprising:

a housing having a vertical separation wall forming a filling chamber on one side and having a horizontal separation wall on the other side, the horizontal separation wall forming a cooling chamber there beneath;

a quantity of a liquid in the filling chamber with an apertured horizontal plate at about the middle elevation of the filling chamber and a smaller end-user tank on the plate, the level of liquid being sufficient to immerse and contact the lower portion of a smaller end-user tank;

an air conditioning system including a compressor unit located in the cooling chamber and a refrigerant coil in the filling chamber beneath the plate;

a large supply tank of gas located remotely from the housing and a supply tube connecting the large supply tank with the smaller end-user tank within the housing.

3. The system as set forth in claim 2 and further including:

a scale supported upon the horizontal separation wall, the scale adapted to weigh the smaller end-user tanks prior to being filled and again after being filled.

4. The system as set forth in claim 2 wherein the fluid is brine.

5. The system as set forth in claim 2 wherein the gas is nitrous oxide.

* * * * *